US009613637B2

(12) United States Patent
Nakayama

(10) Patent No.: US 9,613,637 B2
(45) Date of Patent: Apr. 4, 2017

(54) DRIVING SUPPORT DEVICE

(71) Applicant: DENSO CORPORATION, Kariya, Aichi-pref. (JP)

(72) Inventor: Toshiaki Nakayama, Miyoshi (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/429,423

(22) PCT Filed: Nov. 26, 2013

(86) PCT No.: PCT/JP2013/006921
§ 371 (c)(1),
(2) Date: Mar. 19, 2015

(87) PCT Pub. No.: WO2014/087599
PCT Pub. Date: Jun. 12, 2014

(65) Prior Publication Data

US 2015/0248897 A1 Sep. 3, 2015

(30) Foreign Application Priority Data

Dec. 6, 2012 (JP) ..... 2012-267566

(51) Int. Cl.
*G10L 25/48* (2013.01)
*H04S 7/00* (2006.01)
(Continued)

(52) U.S. Cl.
CPC ..... *G10L 25/48* (2013.01); *H04R 1/00* (2013.01); *H04S 7/30* (2013.01); *G10H 2210/305* (2013.01); *H04R 2217/03* (2013.01); *H04R 2499/13* (2013.01); *H04S 1/00* (2013.01); *H04S 5/00* (2013.01)

(58) Field of Classification Search
USPC ..... 704/270–278
See application file for complete search history.

(56) References Cited

U.S. PATENT DOCUMENTS 5,699,057 A * 12/1997 Ikeda ..... B60Q 9/008 340/435
5,979,586 A * 11/1999 Farmer ..... B60Q 9/008 180/169
(Continued)

FOREIGN PATENT DOCUMENTS

JP 10-206180 A 8/1998
JP 2007-104343 A 4/2007
(Continued)

OTHER PUBLICATIONS

Shi et al.; Development of a Parametric Loudspeaker: A Novel Sound Generation Technology; IEEE Potentials; Nov. 2010; pp. 20-24.*
(Continued)

*Primary Examiner* — Abul Azad
(74) *Attorney, Agent, or Firm* — Posz Law Group, PLC

(57) ABSTRACT

A driving support device for a vehicle uses a right speaker and a left speaker for providing audio information useful for driving to the right ear and left ear of a driver. Among the audio information useful for driving, speech guidance with the use of a voice is provided exclusively from the right speaker to the right ear of the driver.

8 Claims, 4 Drawing Sheets

(51) Int. Cl.

| | |
|---|---|
| ***H04R 1/00*** | (2006.01) |
| *H04S 1/00* | (2006.01) |
| *H04S 5/00* | (2006.01) |

(56) References Cited

U.S. PATENT DOCUMENTS

| | | | | |
|---|---|---|---|---|
| 2006/0001532 | A1* | 1/2006 | Nagata | B60Q 9/008 340/438 |
| 2007/0211574 | A1* | 9/2007 | Croft | G10K 15/02 367/197 |
| 2012/0308056 | A1 | 12/2012 | Nakayama | |
| 2013/0094331 | A1* | 4/2013 | Watanabe | B60Q 5/008 367/137 |

FOREIGN PATENT DOCUMENTS

| | | | | |
|---|---|---|---|---|
| JP | 2007-212368 | A | 8/2007 | |
| JP | 2008-252686 | A | 10/2008 | |
| JP | 2009-129096 | A | 6/2009 | |
| JP | 2009-232011 | A | 10/2009 | |
| JP | 2011-106860 | A | 6/2011 | |
| JP | 2011-172059 | A | 9/2011 | |
| JP | 2012-22487 | A | 2/2012 | |
| JP | 2012-156779 | A | 8/2012 | |
| WO | WO 2012/001871 | A1 * | 1/2012 | H04R 3/00 |

OTHER PUBLICATIONS

International Search Report and Written Opinion of the International Searching Authority dated Mar. 4, 2014 in the corresponding International application No. PCT/JP2013/006921 (and English translation).

Office Action mailed May 19, 2015 issued in corresponding JP patent application No. 2012-267566 (and English translation).

Office Action issued Dec. 1, 2015 in the corresponding JP application No. 2012-267566 (with English translation).

* cited by examiner

DRIVING SUPPORT DEVICE

CROSS REFERENCE TO RELATED APPLICATION

This application is a U.S. national stage of International Application No. PCT/JP2013/006921 filed on Nov. 26, 2013 and is based on Japanese Patent Application No. 2012-267566 filed on Dec. 6, 2012, the disclosure of which is incorporated herein by reference.

TECHNICAL FIELD

The present disclosure relates to a driving support device that performs driving support (i.e., a driver aid) for a driver (i.e., an operator) according to audio information.

BACKGROUND ART

The techniques for informing a driver of "audio information useful for driving" with the use of "speech guidance (such as speech guidance for informing a person of the presence of a pedestrian in a vehicle moving direction, speech guidance for informing a person of the presence of a car at a change destination when changing driving lanes, speech guidance for informing a person of the possibility of a guide word to be appeared on a driving lane, and speech guidance for a car navigation)" has been recently known.

However, judging or comprehending "information" by listening to "speech guidance" gets difficult due to a variety of "speech guidance."

Therefore, the technique for combining "speech guidance" and a "warning sound (i.e., a sound different from speech guidance such as a chime sound or a buzzing sound)" has been proposed (see Patent Document 1).

PRIOR ART LITERATURES

Patent Literature

Patent Literature 1: JP-2007-212368 A

SUMMARY OF INVENTION

Even if a "warning sound" is combined into "speech guidance," the speech center in a brain takes time to comprehend speech (i.e., the content in speech guidance); therefore, it is difficult to comprehend a variety of "speech guidance" instantly.

It is an object of the present disclosure to provide a driving support device for allowing a driver to instantly comprehend a variety of "speech guidance."

According to a support driving device in the present disclosure, "speech guidance" with the use of voice (i.e., speech) is directly provided to a right ear of a driver from a right speaker. Since the speech center is located at the left brain, "speech guidance" is directly provided to the right ear so that the "speech guidance" preferentially reaches the speech center without being blocked by other voices. As a result, it is possible for a driver to instantly comprehend "speech guidance" even if having a variety of "speech guidance."

BRIEF DESCRIPTION OF DRAWINGS

The above and other objects, features and advantages of the present disclosure will become more apparent from the following detailed description made with reference to the accompanying drawings. In the drawings.

EMBODIMENTS FOR CARRYING OUT INVENTION

The following describes an aspect of the present disclosure in detail.

Embodiment

Embodiments are described with reference to FIG. 1 through FIG. 4.

A driving support device in the embodiments is configured to include:

(a) an audio information generation unit 1 for generating an audio signal (i.e., an electrical signal) of "useful driving information" in response to, for example, a driving state of an automobile detected by sensors;

(b) a right ear parametric speaker 2 for generating a reproduced sound at a right ear of a driver 100; and (c) a left ear parametric speaker 3 for generating a reproduced sound at a left ear of the driver 100.

The "useful driving information" is the combination of a plurality of kinds of "speech guidance" and a plurality of "warning sounds," and the audio information generation unit 1 easily generates a plurality of "audio signals (i.e., electrical signals) for speech guidance" and a plurality of "audio signals (i.e., electrical signals) for warning sounds."

Examples of the plurality of kinds of "speech guidance" are as follows:

(i) speech guidance for informing a person of unexpected running out of a pedestrian from the right front of a vehicle;

(ii) speech guidance for informing a person of unexpected running out of a pedestrian from the left front of a vehicle;

(iii) speech guidance for informing a person of the presence of a vehicle on the right when changing to a right driving lane;

(iv) speech guidance for informing a person of the presence of a vehicle on the left when changing to a left driving lane;

(v) speech guidance for informing a person of a vehicle being pushed out to the right of a lane due to centrifugal force in a time of curving;

(vi) speech guidance for informing a person of a vehicle being pushed out to the left of a lane due to centrifugal force in a time of curving;

(vii) speech guidance for informing a person of the presence of an obstacle when turning back; and (viii) speech guidance for informing a person of a seat belt not being fastened.

(It is noted that the above examples are intended for understanding, and the "speech guidance" is not particularly restricted.)

Examples of the plurality of "warning sounds" are as follows:

(i) Beep-Beep-Beep, Beep-Beep-Beep;

(ii) Boo-Boo-Boo, Boo-Boo-Boo;

(iii) Beep-Beep-Beep-Beep, Beep-Beep-Beep-Beep;

(iv) Boo-Boo-Boo-Boo, Boo-Boo-Boo-Boo;

(v) Beeeeeep, Beeeeeep;

(vi) Boooooo, Boooooo;

(vii) Bleep-Beep, Bleep-Beep; and (viii) Bleep-Bleep, Bleep-Bleep.

(It is noted that the above examples are intended for understanding, and the "warning sound" is not particularly restricted.)

"Different kinds of warning sounds" may be created by changing the consecutive number or recurrence interval of the warning sounds.

Figure 1:
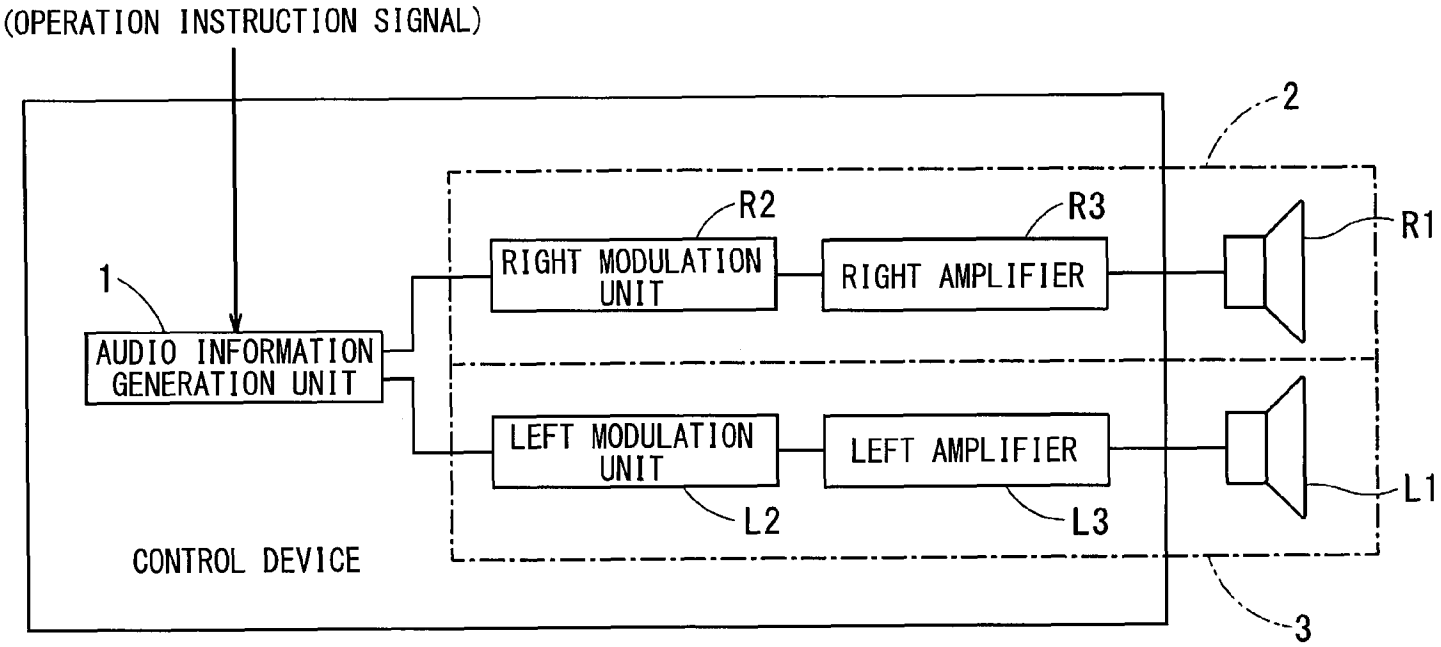
FIG. 1 It is a diagram that shows a stereophonic device in a driving support device according to an embodiment in the present disclosure.
Figure 2A:
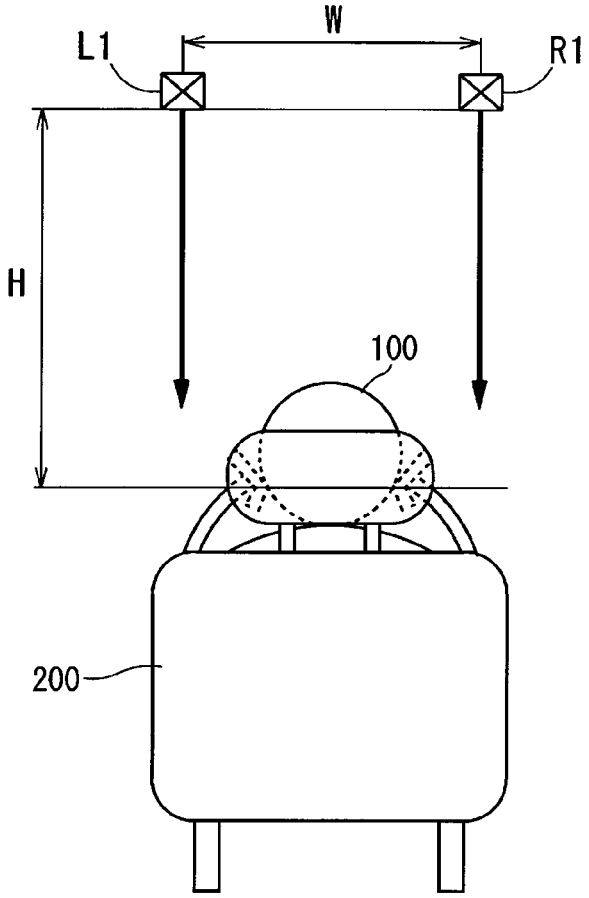
FIG. 2A It is a diagram that shows a loudspeaker arrangement seen from the rear of a seat.
Figure 2B:
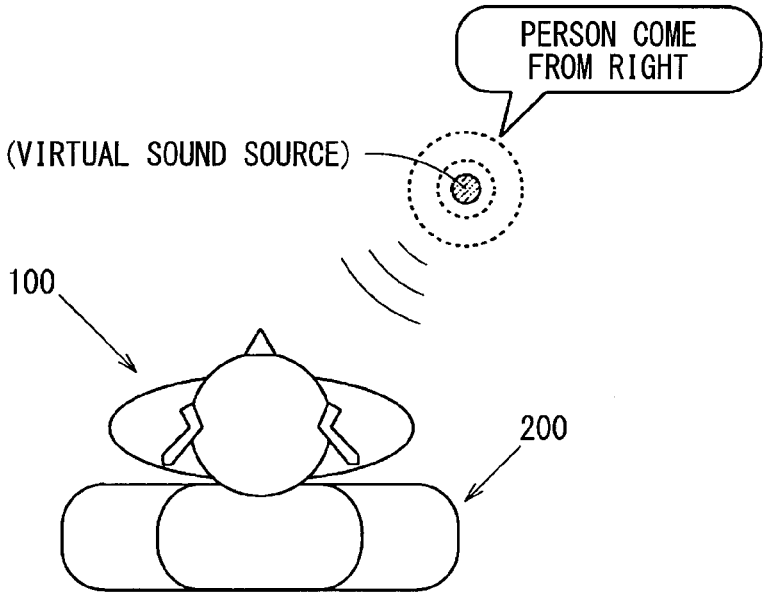
FIG. 2B It is a diagram that shows sound image localization (i.e., a virtual sound source) to be recognized by a person through binaural reproduction.

It is noted that FIG. 2B is an example for understanding, and speech guidance for informing a person of unexpected running out of a pedestrian from the right front of a vehicle is localized at the right side of the driver 100.

Figure 3:
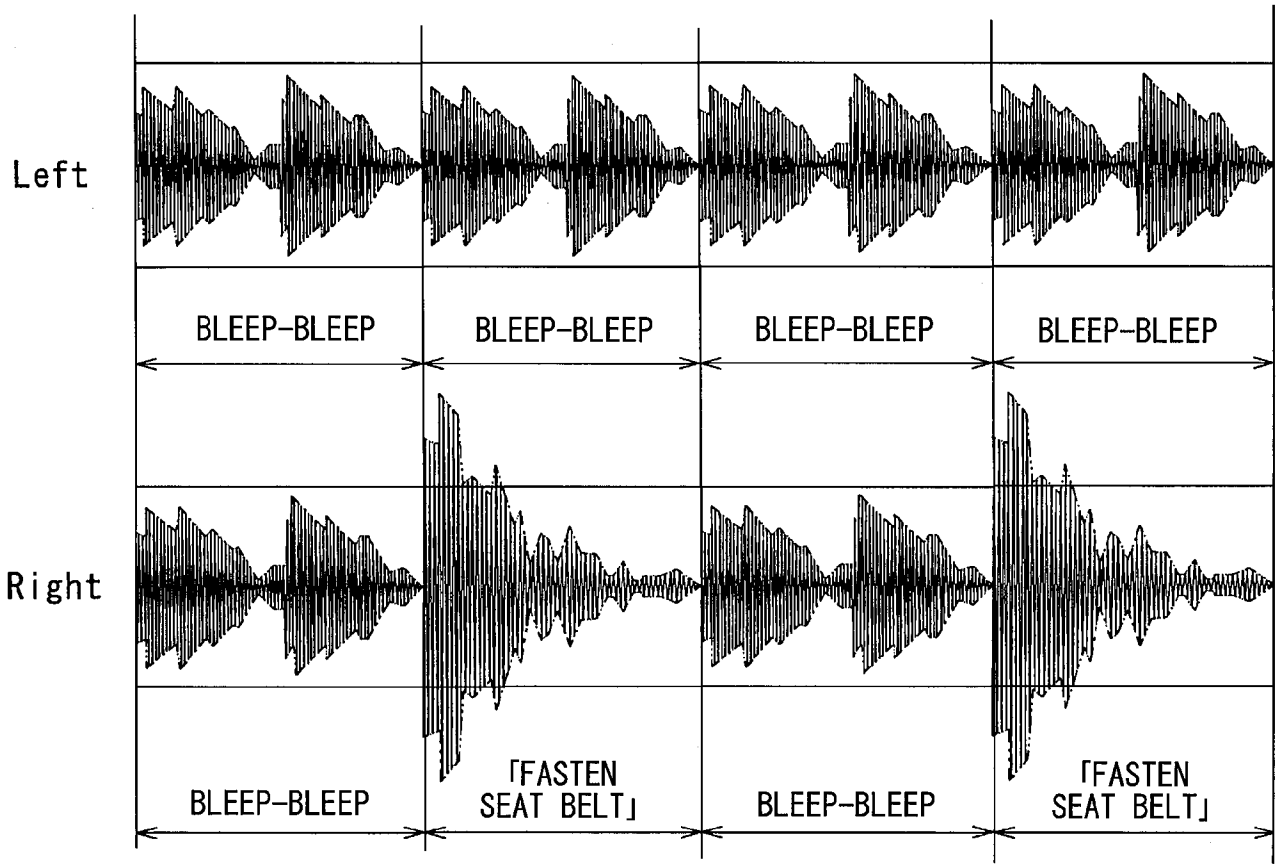
FIG. 3 It is a diagram that shows a "warning sound" and "speech guidance" reproduced by left and right speakers.
Figure 4:
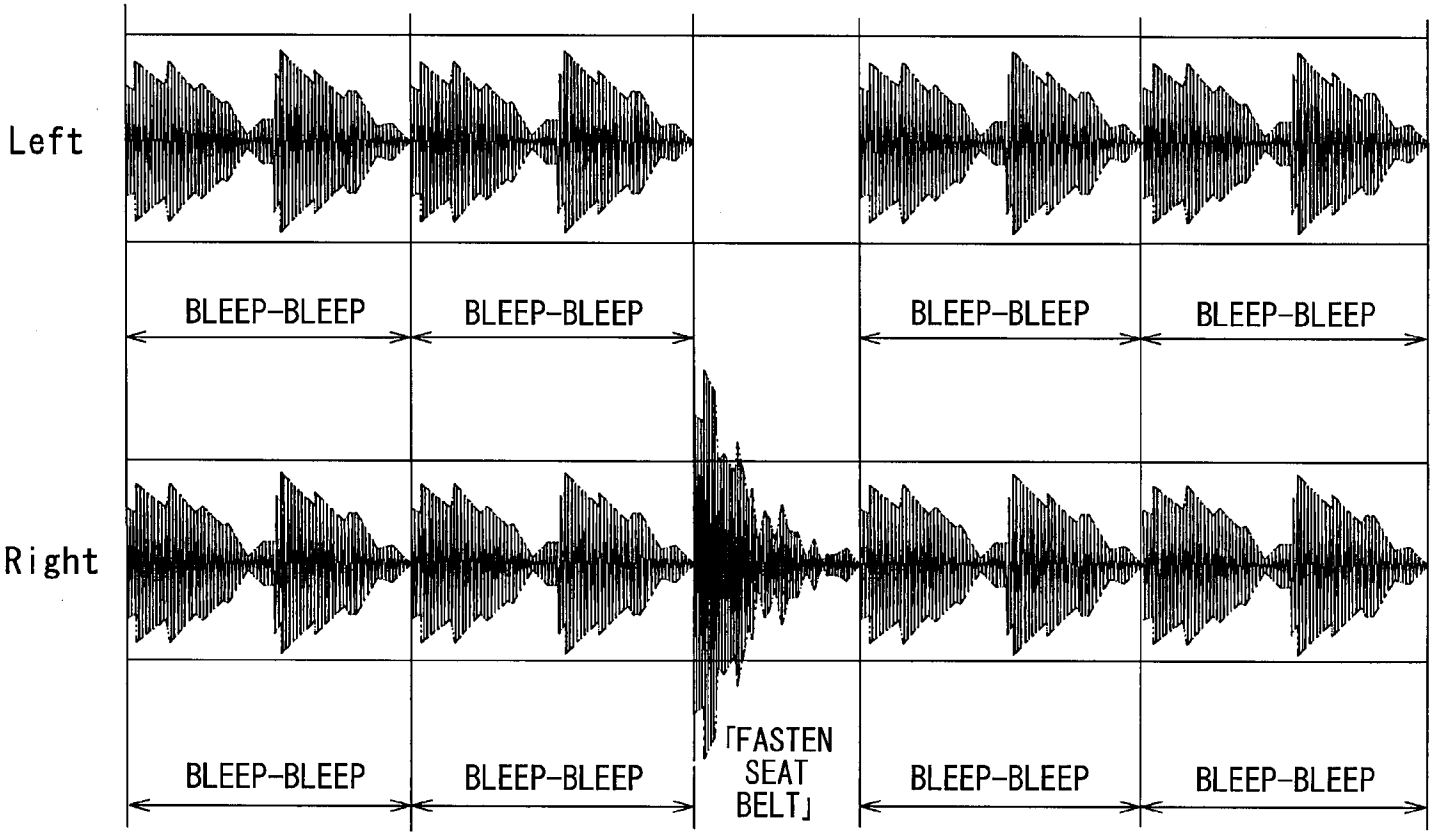
FIG. 4 It is a diagram that shows the "warning sound" and the "speech guidance" reproduced by the left and right speakers.

FIG. 3 and FIG. 4 are also examples for understanding that show the combination of "speech guidance for informing a person of a seat belt not being fastened (i.e., please fasten the seat belt)" and a "warning sound (i.e., bleep-bleep)."

The audio information generation unit 1 generates:

(i) an audio signal localized by a sound image at the right side of the driver 100 (i.e., a binaural signal localized by a sound image in the right direction of the driver 100) when generating a signal related to the right side of the vehicle; or (ii) an audio signal localized by a sound image at the left side of the driver 100 (i.e., a binaural signal localized by a sound image in the left direction of the driver 100) when generating a signal related to the left side of the vehicle.

Binaural recording is a two-channel recording technology utilized for recording with the use of left and right microphones arranged in left and right pseudo ears of a dummy head mimicking a person's head, and is typically known as a recording technology for providing a stereophonic sound to a person who wears a headphone.

It is noted that binaural recording in the embodiments records reproduced sound (i.e., a sound with the combination of speech guidance and a warning sound) provided to a dummy head by a parametric speaker.

A right ear parametric speaker 2 ultrasonic-modulates an audio signal for a right channel (i.e., a speech guidance signal and a warning signal for the right channel) to be generated by the audio information generation unit 1 and then irradiates the ultrasound on the right ear of the driver 100, and directly generates a reproduced sound (i.e., speech guidance and a warning sound for the right channel) toward the right ear of the driver 100. The parametric speaker 2 includes a right speaker R1 for generating ultrasound toward the right ear of the driver 100, a right ultrasonic modulation unit R2 for modulating a right-channel audio signal to be generated by the audio information generation unit 1 to an ultrasonic frequency, and a right power amplifier R3 (for example, a B-class amplifier or a D-class amplifier) for driving the right speaker R1 according to a modulation signal modulated by the right ultrasonic modulation unit R2.

Similarly, a left ear parametric speaker 3 ultrasonic-modulates an audio signal for a left channel (i.e., a speech guidance signal and a warning signal for the left channel) to be generated by the audio information generation unit 1 and then irradiates the ultrasound on the left ear of the driver 100, and directly generates reproduced sound (i.e., speech guidance and warning sound for the left channel) toward the left ear of the driver 100. The parametric speaker 2 includes a left speaker L1 for generating ultrasound wave toward the left ear of the driver 100, a left ultrasonic modulation unit L2 for modulating an audio signal for the left channel to be generated by the audio information generation unit 1 to an ultrasonic frequency, and a left power amplifier L3 (for example, a B-class amplifier or a D-class amplifier) for driving the left speaker L1 according to a modulation signal modulated by the left ultrasonic modulation unit L2.

The right speaker R1 and the left speaker L1 are ultrasound generation devices for generating ultrasound in left and right parametric speakers, and convert electrical signals (i.e., amplifier driving signals) to air vibration and generate air vibration with relatively higher frequency (i.e., over 20 kHz) than a human's audible band.

The particular ultrasound generation device used for the right speaker R1 and the left speaker L1 is not restricted to any particular form. With regard to the embodiment as a particular example, a plurality of piezoelectric elements for generating ultrasound are collectively arranged in an array form.

The right speaker R1 emits ultrasound toward the right ear of the driver 100 sitting on a driver seat 200, whereas the left speaker L1 emits ultrasound toward the left ear of the driver 100 sitting on the driver seat 200.

In particular, as shown in FIG. 2, (i) the right speaker R1 is disposed such that ultrasound irradiation direction (i.e., a central axis of ultrasound irradiation) faces the position of the right ear of the driver 100; and (ii) the left speaker L1 is disposed such that ultrasound irradiation direction (i.e., a central axis of ultrasound irradiation) faces the position of the left ear of the driver 100.

The mounting positions of the right speaker R1 and the left speaker L1 are not particularly restricted. For example, the mounting position may be arranged on a ceiling, a headrest or a sheet, or on a dashboard or a pillar.

The embodiment shows the arrangement of the right speaker R1 and the left speaker L1 above the driver 100 as a particular mounting example. Accordingly, providing the right speaker R1 and the left speaker L1 above the driver 100 prevents penetrating sound or reflection sound to be heard at the rear of a seat.

The distance H from the right speaker R1 or the left speaker L1 to the rear position of the driver 100 is not particularly restricted. The distance H varies according to the ceiling position of a vehicle or the like.

The arrangement spacing W between the right speaker R1 and the left speaker L1 is not particularly restricted. However, in order to prevent sound reflection to an assistant seat, the arrangement spacing W is provided to be, for example, equal to or more than 15 cm (preferably 20 cm or more), and equal to or less than 45 cm.

It is noted that each of the right speaker R1 and the left speaker L1 is provided such that the ultrasound irradiation direction is adjustable (it is noted that both are not particularly restricted). Accordingly, the ultrasound irradiation direction accurately faces toward the positions of left and right ears of the driver 100 in response to the height position of a head and the front-back position of a seat.

The operation of the parametric speaker is described below.

When the audio information generation unit 1 generates "an audio signal for speech guidance" and "an audio signal for a warning sound," "ultrasound obtained by modulating the audio signals for the speech guidance and the warning sound" is irradiated toward the left and right ears of the driver 100.

As "ultrasound obtained by ultrasonic-modulating audio signals for speech guidance and a warning sound" propagates in air, the ultrasound having a relatively shorter wavelength is distorted due to viscosity of air or the like. Thus, an amplitude component included in the ultrasound in air during propagation is self-modulated and "speech guidance and a warning sound" are reproduced at the left and right ears of the driver 100. Alternatively, the ultrasound arrived at the head of the driver 100 before modulation is self-modulated at the head (i.e., nearby the ear) of the driver 100 so that "speech guidance and a warning sound" are reproduced at the left and right ears of the driver 100.

Accordingly, a reproduced sound is directly generated at the left and right ears of the driver 100, the reproduced sound substantially identical to a sound from a headphone is provided to the driver 100.

As described above, the driving support device according to the embodiment generates "speech guidance and a warning sound" at the left and right ears of the driver 100 with the use of the right speaker R1 and the left speaker L1 to provide "audio information useful for driving" to the driver 100.

The driving support device according to the embodiment generates "speech guidance" from the right speaker R1 exclusively and provides the "speech guidance" to the right ear of the driver 100 when generating the "speech guidance."

When "speech guidance" is generated from the right speaker R1 to the right ear of the driver 100, (i) a "warning sound" is continuously provided from the left speaker L1 to the left ear of the driver 100 for emphasizing a warning as shown in FIG. 3; or (ii) the left speaker L1 is mute so that "speech guidance" provided to the right ear can be easily heard as shown in FIG. 4.

First Effect in the Embodiment

The driving support device in the embodiment directly provides "speech guidance" to the right ear of the driver 100 exclusively from the right speaker R1 when generating "audio information useful for driving" with the combination of "speech guidance" and a "warning sound." Since the speech center is in the left brain, "speech guidance" is directly provided to the right ear so that the "speech guidance" preferentially reaches the speech center without being blocked by other sounds. As a result, the driver instantly comprehends the provided "speech guidance" even if having a variety of "speech guidance."

In other words, even if having a variety of "speech guidance," the "speech guidance" provided to the driver 100 according to the present disclosure can be comprehended instantly by the driver 100.

Effect 2 in the Embodiment

The driving support device according to the embodiment provides "useful driving information" to "the driver 100 exclusively" from the "parametric speaker."

Accordingly, passengers other than the driver 100 are not irritated by the "useful driving information." For example, "useful driving information" is configured not to be heard by passengers, and is configured to be heard by the driver 100 exclusively during the travel of a night bus.

Effect 3 in the Embodiment

The driving support device according to the embodiment configures "speech guidance" to be in rhythm. The "speech guidance" in rhythm is relatively easier to be heard than "flat speech guidance (i.e., speech guidance in a flat monotone)."

Therefore, "speech guidance" which is easily to be heard prevents a misjudgment caused by mishearing even if having a variety of "speech guidance."

Effect 4 in the Embodiment

The driving support device according to the embodiment includes "subliminal audio information" in audio information provided to the driver 100.

In particular, since the right speaker R1 and the left speaker L1 used in the embodiment are ultrasound generation devices, "audio information provided according to an ultrasonic frequency," which cannot be directly heard by the driver 100, is provided to the driver 100 as the "subliminal audio information (i.e., subliminal speech guidance)."

Since the driver 100 comprehends "useful driving information" unconsciously according to the "subliminal audio information," the "speech guidance" may be instantly comprehended due to a subliminal effect.

Effect 5 in the Embodiment

In the driving support device according to the embodiment, "speech guidance with different content" is individually in combination in accordance with a "different warning sound." That is, a "warning sound" to be combined according to the "content of speech guidance" is different.

Accordingly, a "warning sound" and "speech guidance" are linked unconsciously due to the familiarity (i.e., learning) of the driver 100, and "the content of speech guidance" is estimated by only hearing the beginning of the "warning sound."

As a result, even if having a variety of "speech guidance," the "speech guidance" is comprehended instantly according to the learning effect of the driver 100 due to familiarity of a "warning sound" to be combined.

Modifications

While the present disclosure has been described with reference to embodiments thereof, it is to be understood that the disclosure is not limited to the embodiments and constrictions. The present disclosure is intended to cover various modification and equivalent arrangements. In addition, while the various combinations and configurations, other combinations and configurations, including more, less or only a single element, are also within the spirit and scope of the present disclosure.

The above embodiment shows an example of using a parametric speaker; however, a dynamic speaker may be used.

In addition, the driving support device may be combined with an "audio system such as a music device or a radio set" to provide "a sound wave such as music or radio" for the driver 100 exclusively.

The invention claimed is:

1. A driving support device providing audio information useful for driving to a driver of a vehicle according to speech guidance by using voice and a warning sound, wherein the driving support device provides the audio information useful for driving to a left ear and a right ear of the driver by using a right speaker and a left speaker to generate the speech guidance and the warning sound;

wherein the right speaker is an ultrasound generation device for a right ear parametric speaker that generates a reproduced sound at the right ear by irradiating ultrasound toward a right ear position of the driver sitting on a driver seat of the vehicle;

wherein the left speaker is an ultrasound generation device for a left ear parametric speaker that generates the reproduced sound at the left ear by irradiating ultrasound toward a left ear position of the driver sitting on the driver seat; and wherein the speech guidance among the audio information useful for driving is provided directly to the right ear of the driver exclusively from the right speaker.

2. The driving support device according to claim 1, wherein the speech guidance is made in rhythm.

3. The driving support device according to claim 1, wherein the audio information provided to the driver includes subliminal audio information.

4. The driver support device according to claim 1, wherein the speech guidance with different content is individually in combination in accordance with a different warning sound.

5. The driver support device according to claim 1, wherein the warning sound is continuously provided from the left speaker to the left ear of the driver during the providing of the speech guidance from the right speaker to the right ear of the driver.

6. The driver support device according to claim 1, wherein the left speaker is muted during the providing of the speech guidance from the right speaker to the right ear of the driver.

7. A driving support device providing audio information useful for driving to a driver of a vehicle according to speech guidance by using voice and a warning sound, comprising:

a right ear parametric speaker that generates the speech guidance provided to a right ear of the driver; and a left ear parametric speaker that generates the warning sound to a left ear of the driver, wherein the right ear parametric speaker includes a right speaker and an ultrasound generation device that generates a reproduced sound at the right ear by driving the right speaker to irradiate ultrasound toward a right ear position of the driver sitting on a driver seat of the vehicle;

wherein the left ear parametric speaker includes a left speaker and an ultrasound generation device that generates the reproduced sound at the left ear by driving the left speaker to irradiate ultrasound toward a left ear position of the driver sitting on the driver seat; and wherein the speech guidance is provided directly to the right ear of the driver exclusively from the right speaker.

8. A driving support device providing audio information useful for driving to a driver of a vehicle according to speech guidance by using voice and a warning sound, comprising:

an audio information generating unit configured to generate audio signals including speech guidance information useful for driving and warning sounds other than speech guidance;

a right ear parametric speaker irradiating an ultrasound toward a right ear position of a driver sitting on a driver seat of the vehicle; the right ear parametric speaker comprising a right speaker driven by a right amplifier and an ultrasound generation device, the right ultrasound generation device receiving the audio signals from the audio information generating unit and modulating the received audio signals to an ultrasonic frequency constituting the ultrasound, and the right amplifier driving the right speaker according to the ultrasound;

a left ear parametric speaker irradiating an ultrasound toward a left ear position of a driver sitting on a driver seat of the vehicle; the left ear parametric speaker comprising a left speaker driven by a left amplifier and an ultrasound generation device, the left ultrasound generation device receiving the audio signals from the audio information generating unit and modulating the received audio signals to an ultrasonic frequency constituting the ultrasound, and the left amplifier driving the left speaker according to the ultrasound, wherein the speech guidance among the audio information useful for driving is provided directly to the right ear of the driver exclusively from the right speaker.

* * * * *